US005544720A

United States Patent [19]

Spiess

[11] Patent Number: 5,544,720

[45] Date of Patent: Aug. 13, 1996

[54] ENTRAINING AND UNLATCHING APPARATUS FOR ELEVATOR DOORS

[75] Inventor: Peter A. Spiess, Meggen, Switzerland

[73] Assignee: Inventio AG, Hergiswil NW, Switzerland

[21] Appl. No.: 378,597

[22] Filed: Jan. 26, 1995

[30] Foreign Application Priority Data

Feb. 21, 1994 [EP] European Pat. Off. ..... 94102545.4

[51] Int. Cl.[6] ..... B66B 13/12

[52] U.S. Cl. ..... 187/319; 187/330; 187/331; 187/333

[58] Field of Search ..... 187/319, 330, 187/331, 333, 334, 335

[56] References Cited

U.S. PATENT DOCUMENTS

| | | | |
|---|---|---|---|
| 3,231,048 | 1/1966 | Mitchell | 187/319 |
| 3,598,202 | 8/1971 | Kirsch et al. | 187/319 X |
| 3,783,977 | 1/1974 | Voser | 187/319 |

FOREIGN PATENT DOCUMENTS

| | | | |
|---|---|---|---|
| 1073992 | 8/1992 | Australia | 187/330 X |
| 498247 | 8/1992 | European Pat. Off. | 187/330 X |
| 1005032 | 4/1952 | France . | |
| 1456392 | 3/1969 | Germany . | |
| 3158379 | 7/1991 | Japan | 187/334 X |

*Primary Examiner*—William E. Terrell
*Assistant Examiner*—Dean A. Reichard
*Attorney, Agent, or Firm*—Howard & Howard Atty.

[57] ABSTRACT

An apparatus for entraining and unlatching an elevator car door and a shaft door includes an electromagnet having a movable armature attached to a first bellows mounted on a wall of the car. An entraining and unlatching cam is attached to a second bellows which is mounted on the car door. The cam has stiffened cam entry surfaces, cam surfaces and front surface. The bellows are connected by a hose as a closed pneumatic system operating with below atmospheric pressure. When the electromagnet is not actuated, an internal compression spring in the second bellows extends the cam into engagement with rollers mounted on a shaft door to splay the rollers thereby unlatching the shaft door and entraining it with the car door. At the same time, the first bellows retracts the armature to unlatch the car door. When the electromagnet is actuated, the armature latches the car door and the second bellows retracts the cam to permit the rollers to fold toward one another thereby latching the shaft door. The movements of the bellows are detected by microswitches which are connected with a monitoring circuit which controls a pump to maintain the desired pressure in the system.

19 Claims, 1 Drawing Sheet

ENTRAINING AND UNLATCHING APPARATUS FOR ELEVATOR DOORS

BACKGROUND OF THE INVENTION

The present invention relates generally to an apparatus for unlatching and entraining elevator car doors and shaft doors and, in particular, to such an apparatus having a pneumatic actuating system.

The French Patent Specification No. 1.005.032 shows an extendable and retractable entraining and unlatching device for an elevator system. The retraction and unlatching is caused by the excitation of two electromagnets against the force of a tension spring. The extension and latching is caused by turning off the electromagnets whereby the tension spring moves a lever system to raise the magnet armatures and push the entraining and unlatching element outwardly into the latched position.

This type of entraining and unlatching element has several moving parts which are subject to substantial wear, and are not easily accessible for maintenance and repairs. Furthermore, noise problems can arise in magnet actuated systems of this kind.

SUMMARY OF THE INVENTION

The present invention concerns an entraining and unlatching apparatus for elevator doors including an actuator means for mounting on a wall of an elevator car, the actuator means being selectively actuatable for latching and unlatching a door of the elevator car; an entraining and unlatching cam for mounting on the elevator car door, the cam being movable in a generally horizontal direction for extending toward and retracting from entraining and unlatching rollers mounted on an elevator shaft door when the elevator car is adjacent the shaft door; a first variable volume means associated with the actuator means; a second variable volume means associated with the entraining and unlatching cam; and a flexible connector connected between the first and second variable volume means, the connector and the first and second variable volume means being in fluid communication and retaining a predetermined volume of fluid. When the actuator means is actuated to latch the car door, the fluid flows in one direction between the first and second variable volume means to retract the cam and when the actuator means is not actuated, the car door is unlatched and the fluid flows in an opposite direction between the first and second variable volume means to extend the cam.

The connector and the first and second variable volume means can be connected in a closed system and the fluid can be at less than atmospheric pressure or at greater than atmospheric pressure. Furthermore, when the actuator means is not actuated, the connector and the first and second variable volume means can be connected in an open system in fluid communication with atmospheric pressure.

The actuator means includes an electromagnet having an armature movable into and out of a latch opening formed in the car door and the first variable volume means can be a bellows having one end attached to the car wall and an opposite end attached to the armature. The entraining and unlatching cam can include at least one cam entry surface connected to at least one cam surface for engaging the entraining and unlatching rollers and the second variable volume means can be a bellows having one end attached to the car door and an opposite end attached to the cam entry surface and the cam surface.

The apparatus can include an elastic beating block for mounting on the shaft door, a pair of axles each having one end attached to the block and a pair of entraining and unlatching rollers, each roller being mounted on a respective one of the axles for engaging the cam, the block permitting the axles to splay apart and fold together.

Furthermore, at least one microswitch can be mounted in each of the bellows for sensing operation of the bellows. A monitoring circuit is connected to the microswitches and to a pump in fluid communication with the connector and the bellows. The monitoring circuit is responsive to signals generated by the microswitches for controlling the pump to maintain the desired pressure in the system.

The present invention is based on the object of creating an entraining and unlatching apparatus for elevator doors which has fewer parts subject to wear and executes more functions than existing devices.

The advantages of the present invention are that it has no mechanically rubbing parts subject to wear and that the actuating portion and the entraining portion can be mounted separately. A further advantage is that the actuating portion also unlatches the car door.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
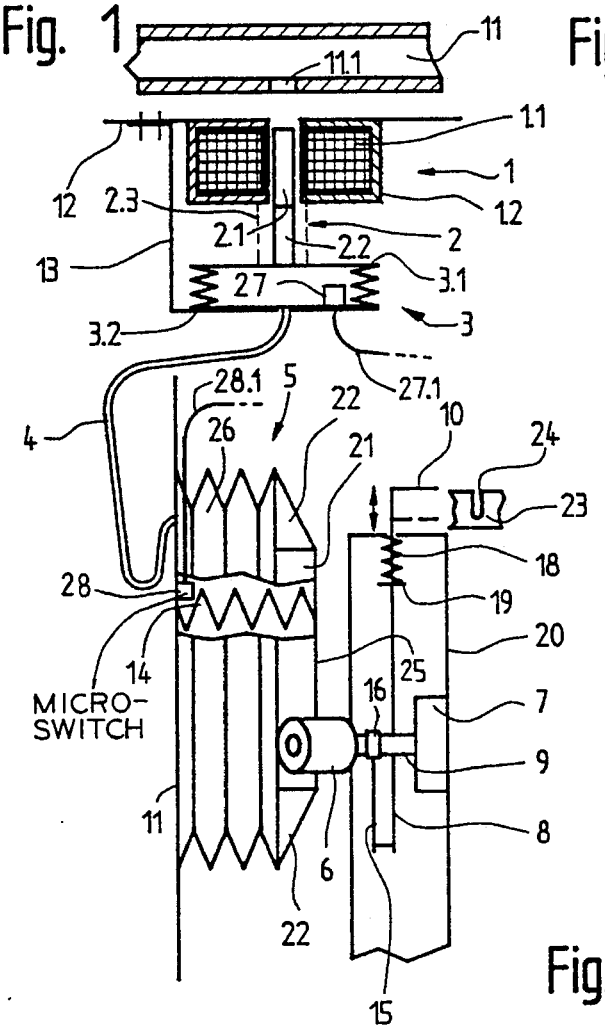
FIG. 1 is a fragmentary schematic view of an elevator door entraining and unlatching apparatus in accordance with the present invention with a latch actuator in plan view in a not actuated and unlatched state and an entraining and unlatching element in side elevation view engaged with an elevator shaft door.

In FIG. 1, there is shown an apparatus which latches an elevator car door wing to a wall of the elevator car during travel of the car and unlatches the car door wing and operates a shaft door entraining and unlatching mechanism when the car is stopping at a floor. The apparatus includes an electromagnet 1 which has a magnet coil 1.1 mounted in a magnet housing 1.2. The electromagnet 1 is fastened to a wall 12 of an elevator car adjacent a car door wing or panel 11 which moves in a plane parallel to a plane of the wall. About one half of the length of a bolt-shaped magnet armature 2 projects into a central opening formed through the coil 1.1 and the housing 1.2 of the electromagnet 1. The magnet armature 2 consists of a front portion 2.1, formed of a magnetically nonconductive material, which front portion extends into the central opening and is attached to a rear portion 2.2 formed of a magnetically conductive material. The rear portion 2.2 has a free end which is attached to or formed integral with a rear end plate 3.1 of a first air actuated bellows 3. The bellows 3 has a front end plate 3.2 which is fastened to a metal carrier plate 13 attached to the car wall 12 adjacent the housing 1.2. As discussed below, a free end of the front portion 2.1 can be extended from the electromagnet 1 through an aperture in the wall 12 and into engagement with a latch opening 11.1 formed in the car door wing 11. The electromagnet 1, the armature 2 and the bellows 3 function as a car door latching and unlatching means and as an actuator for unlatching and opening a shaft door.

Figure 2:
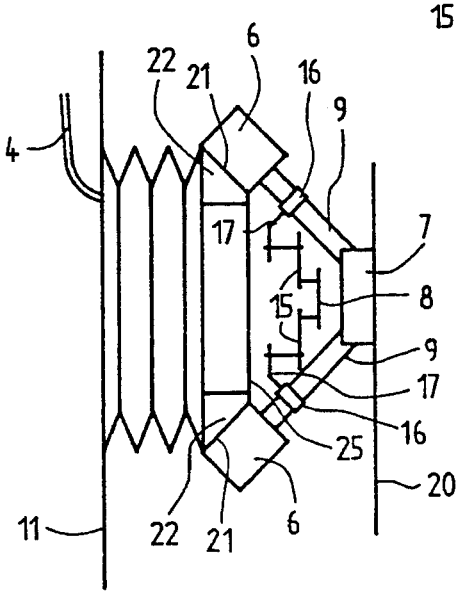
FIG. 2 is a fragmentary schematic plan view of the entraining and unlatching element shown in the FIG. 1.

An air hose 4 has one end attached to the front end plate 3.2 and is in fluid communication with an interior of the bellows 3. As shown in the FIGS. 1 and 2, an opposite end of the hose 4 is attached to a second air actuated bellows 26 and is in fluid communication with the interior thereof. The second bellows 26 is included in an entraining and unlatching element or cam 5 and is mounted at one end on a surface of the car door wing 11. At least one compression spring 14 is mounted in the interior of the bellows 26 to urge the cam 5 into the extended position shown. On the end of the cam 5 facing an elevator shaft door 20, at each end of both a top and a bottom edge thereof, are provided chamfered cam entry surfaces 22. The surfaces 22 at the top and bottom of each side are connected by a vertically extending chamfered cam surface 21. A generally planar front surface 25, which extends parallel to a facing surface of the shaft door 20, is connected to the cam surfaces 21 and 22 to form the frontal termination for the cam 5. Each of the cam surfaces 21 and 22 and the front surface 25 is constructed of a stiffened material. The opposite end of the bellows 26 is attached to the cam surfaces 21 and 22 and to the front surface 25.

The entraining and unlatching cam 5 is contacted by a pair of entraining and unlatching rollers 6 which engage the cam surfaces 21 when the elevator car is arriving adjacent the shaft door 20 during upward and downward travel. The rollers 6 are each rotatably retained at one end of a respective one of a pair of roller axles 9. An opposite end of each of the axles 9 extends inside the shaft door 20 and is connected to an elastic bearing block 7 which is attached to an internal surface of the shaft door. As shown in the FIG. 2, each of the roller axles 9 extends through an associated setting ring 16 which ring is attached to one end of an associated lever 17. Each of the levers 17 has an opposite end articulately connected with one end of an associated tie strap 15. The opposite end of each of the tie straps 15 is articulately connected to a lower end of a vertically extending push rod 8. The push rod 8 extends through an opening in an upper end wall of the shaft door 20 and is terminated by a horizontally extending bar 10 as shown in the FIG. 1. The bar 10 engages a generally vertically extending bar slot 24 formed in a shaft door frame 23 when the push rod 8 is moved downwardly (dashed line). The push rod 8 is urged downwardly by a compression spring 18 extending between an abutment 19 formed on the rod and an inner surface of the upper end wall of the shaft door 20. As shown in the FIG. 2, the ends of the levers 17 connected to the tie straps 15 are bent slightly inwardly toward one another but are spaced apart by the splaying of the entraining and unlatching rollers 6. The tie straps 15 and the push rod 8 are arranged one behind the other and are connected by hinge pins. The elastic bearing block 7 is formed, for example, as an homogeneous rubber block into which the roller axles 9 are cast and which permits an elastic splaying movement of the roller axles 9. In the FIGS. 1 and 2, the entraining and unlatching apparatus is illustrated in the not actuated and unlatched state.

Figure 3:
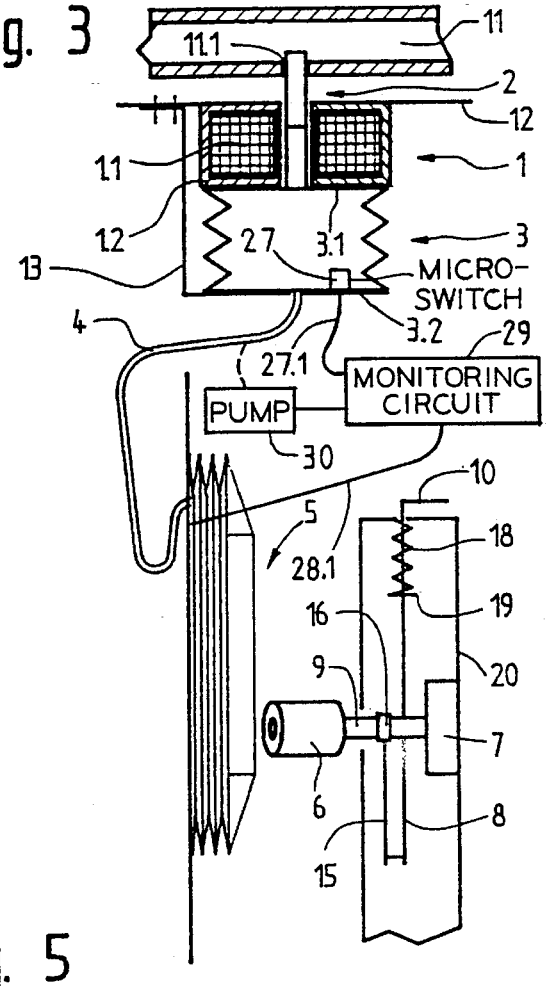
FIG. 3 is a view similar to the FIG. 1 showing the latch actuator in an actuated and latched state and the entraining and unlatching element in the disengaged state.
Figure 4:
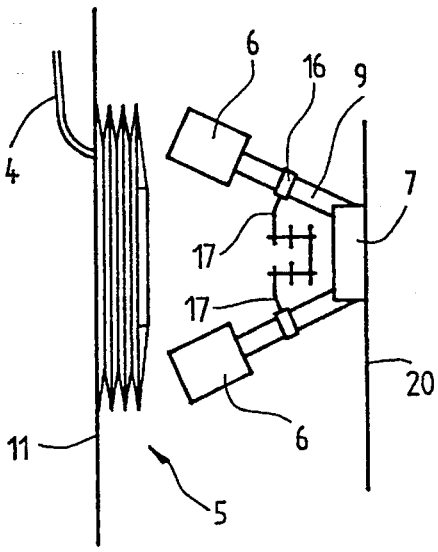
FIG. 4 is a view similar to the FIG. 2 showing the entraining and unlatching element in the disengaged state.

In the FIGS. 3 and 4, the entraining and unlatching apparatus is illustrated in the actuated and latched state which occurs when the electromagnet 1 excited. In the Fig. 4, the entraining and unlatching rollers 6 are shown disposed in the rest position or the contracted state. The angle between the contracted entraining and unlatching rollers 6 is determined by the contact of the facing ends of the levers 17 which act as limiting abutments, since otherwise the bearing block 7 would permit the roller axles 9 to continue to move toward one another.

Figure 5:
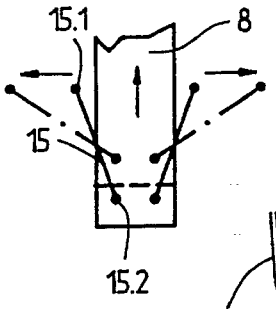
FIG. 5 is a schematic diagram showing the movement of the entraining and unlatching linkage shown in the FIGS. 1 through 4 during shaft door latching and unlatching.

The mechanical principle of the shaft door latching is illustrated in the FIG. 5. Each of the tie straps 15 is connected with the associated one of the levers 17 at an upper joint connection 15.1 and is connected with the push rod 8 at a lower joint connection 15.2. The tie straps 15, which are illustrated schematically as lines, are shown in two different settings in the FIG. 5; namely as solid lines in the retracted position of the entraining and unlatching rollers 6 and as dashed lines in the splayed position of the entraining and unlatching rollers. Similarly, the push rod 8 is illustrated in two different positions in the FIG. 5. The vertical distance between the solid line and the dashed line, which lines represent the lower end face of the push rod 8, corresponds to the vertical stroke travel of the push rod during the splaying of the entraining and unlatching rollers 6.

The entraining and unlatching apparatus according to the present invention functions in the manner described below. A gas, for example air, is preferably provided as a transmission or actuation medium. The air is disposed in a closed system formed of the interiors of the bellows 3 and 26 and the interior of the air hose 4. In the non-excited state of the electromagnet 1, shown in the FIGS. 1 and 2, the spring 14 urges the bellows 26 into the extended position and the entraining and unlatching cam 5 forwardly. As the bellows 26 is extended it sucks the air out of the interior of the bellows 3 which contracts and draws the magnet armature 2 out of the latch opening 11.1 thereby unlatching the car door 11. The extended entraining and unlatching cam 5 moves between the entraining and unlatching rollers 6 upon arrival of the elevator car at a destination floor and splays these rollers as they run over the chamfered cam entry surfaces 22 and onto the cam surfaces 21 shown in the FIG. 2. During the splaying of the entraining and unlatching rollers 6, the push rod 8 is moved upwardly through the movement of the mechanical linkage of the tie straps 15 and the levers 17. The upward movement of the push rod 8 unlatches the shaft door 20 by raising the bar 10 out of the bar slot 24 in the shaft door frame 23. In this position of the entraining and unlatching apparatus, the car door wing 11 and the shaft door 20 are thus unlatched and are mechanically coupled for common entrainment during subsequent opening.

Before the departure of the elevator car from a floor, the shaft door 20 and the car door 11 are closed and latched in the closed position. The latching takes place through the application of a voltage to the coil 1.1, whereupon the armature 2 is drawn into the position shown in the FIG. 3 to latch the car door wing 11 to the car wall 12. The movement of the armature 2 extends the bellows 3 which draws air from the bellows 26 to retract the entraining and unlatching cam 5 out of contact with the rollers 6. The retraction of the entraining and unlatching cam 5 permits the entraining and unlatching rollers 6 to move toward one another (FIG. 4), thereby moving the push rod 8 downwardly and the bar 10 into the bar slot 24 whereupon the shaft door 20 is latched to the shaft door frame 23. During the actuation of the electromagnet 1, the magnetically attracted rear portion 2.2 of the armature 2 is drawn into the opening in the coil 1.1 by magnetic force and the non-magnetic front portion 2.1 is moved through the aperture in the car wall 12 into the latch opening 11.1 to latch the car door 11.

The entraining and unlatching apparatus according to the present invention, requires only that the entraining and unlatching cam 5 be mounted at a predetermined location with respect to the shaft door 20 in order to contact the rollers 6. The actuating portion, which includes the electromagnet 1 and the bellows 3, can be mounted at any convenient location on the car wall 12. However, care must be taken to position the magnet armature 2 so that it will engage the latch opening 11.1. The air hose 4 can be positioned like a flexible electrical cable and installed partially hanging freely between the car wall 12 and the car door wing 11.

In the embodiment shown in the FIGS. 1 through 5, the car door wing 11 and the shaft door 20 are unlatched when voltage is removed from the coil 1.2. The unlatching function can be reversed if the compression spring 14 were to be inserted in the bellows 3 and the front portion 2.1 of the magnet armature 2 were formed of a magnetically conductive material so that unlatching would take place only when voltage is applied to the coil 1.2.

Also, the elastic bearing block 7 can be formed of conventional non-elastic material with bearings in which the roller axles 9 are mounted and a tension spring can be connected between the roller axles to return them to the rest position shown in the FIG. 4.

The stiffened material of the cam entry surfaces 22, the cam surfaces 21 and the front surface 25 of the entraining and unlatching cam 5 can be metal inserts retained in the material of the bellows 26. The material for the manufacture of the bellows 26 preferably consists of a flexible, but not extensible, synthetic material. The bellows 3 also preferably is made from a flexible, but not extensible, synthetic material, wherein the rear end plate 3.1 and the front end plate 3.2 each consist of a hard and rigid material. The end plates 3.1 and 3.2 are maintained parallel during extension and retraction by the armature 2 connected to the rear end plate 3.1 which is guided in the opening in the electromagnet 1. Microswitches 27 and 28 can be located on the end walls in the interiors of the bellows 3 and 26 respectively to be actuated in the contracted state of the bellows to generate signals representing the movement of the bellows. Electrical lines 27.1 and 28.1 connected to the microswitches 27 and 28 respectively pass through sealed apertures formed in the bellows for connection to an external monitoring circuit 29 (FIG. 3). Since air is a compressible fluid, the air in the closed gas system typically is maintained below atmospheric pressure. The monitoring circuit can control a vacuum pump 30 which is connected with the closed gas system and which, in the case of an impermissible change in air pressure in the system, restores the functionally required air pressure.

In an alternate embodiment, the present invention can be built as a pressured system. In this case, a compression spring 2.3 (FIG. 1) is inserted between the magnet housing 1.2 and the rear end plate 3.1 about the magnet armature 2 and the compression spring 14 in the bellows 26 is constructed as a return spring. The compression spring 2.3 located on the magnet armature 2 must be dimensioned to be strong enough so that the entraining and unlatching cam 5 remains in the extended position during the rest state of the apparatus. The air pressure and the return spring 14 in the bellows 26 are so matched in force that the entraining and unlatching cam 5 is retracted when the electromagnet 1 is actuated. The microswitches 27 and 28 and the monitoring circuit 29 described above can be used for monitoring the pressured system with the difference that the pump 30 is a pressure pump rather than a vacuum pump.

In a third embodiment, the apparatus is constructed as an open system connected with atmospheric pressure in the rest state. In this case, the compression spring 2.3 positioned about the magnet armature 2 is used and the compression spring 14 remains in the bellows 26. On actuation of the electromagnet 1, the system is closed by a controlled valve (not shown) and connected to a vacuum source such as the pump 30, because the contraction of the bellows 26 must take place under the influence of less than atmospheric pressure.

In the case of an elevator car with a center opening door, two of the above described apparatuses are used, one for each door wing 11 and associated shaft door 20. The actuating equipment with the electromagnet 1 and the bellows 3 can be used to operate two entraining and unlatching cams 5 simultaneously by branching the hose 4.

If there is no requirement that the actuating portion of the apparatus execute any mechanical latching and unlatching function, a pressure pump or a vacuum pump can be used as an actuator means in place of the electromagnet 1 and the bellows 3.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An entraining and unlatching apparatus for elevators comprising:

an actuator means for mounting on a wall of an elevator car, said actuator means being selectively actuatable for latching and unlatching a door of the elevator car;

an entraining and unlatching cam for mounting on the elevator car door, said cam being movable in a generally horizontal direction for extending toward and retracting from entraining and unlatching rollers mounted on an elevator shaft door when the elevator car is adjacent the shaft door;

a first variable volume means in said actuator means;

a second variable volume means in said entraining and unlatching cam; and a flexible connector connected between said first and second variable volume means, said connector and said first and second variable volume means being in fluid communication and retaining a predetermined volume of fluid, whereby when said actuator means is actuated to latch the car door, said fluid flows in one direction between said first and second variable volume means to retract said cam and when said actuator means is not actuated, the car door is unlatched and said fluid flows in an opposite direction between said first and second variable volume means to extend said cam.

2. The apparatus according to claim 1 wherein said connector and said first and second variable volume means are connected in a closed system and said fluid is at less than atmospheric pressure.

3. The apparatus according to claim 1 wherein said connector and said first and second variable volume means are connected in a closed system and said fluid is at greater than atmospheric pressure.

4. The apparatus according to claim 1 wherein when said actuator means is not actuated, said connector and said first and second variable volume means are in fluid communication with atmospheric pressure.

5. The apparatus according to claim 1 wherein said actuator means includes an electromagnet having an armature movable into and out of a latch opening formed in the car door and said first variable volume means is a bellows having one end attached to the car wall and an opposite end attached to the armature.

6. The apparatus according to claim 1 wherein said entraining and unlatching cam includes at least one cam entry surface connected to at least one cam surface for engaging the entraining and unlatching rollers and said second variable volume means is a bellows having one end attached to the car door and an opposite end attached to said cam entry surface and said cam surface.

7. The apparatus according to claim 1 including an elastic bearing block for mounting on the shaft door, a pair of axles each having one end attached to said block and a pair of entraining and unlatching rollers, each said roller mounted on a respective one of said axles for engaging said cam, said block permitting said axles to splay apart and fold together.

8. The apparatus according to claim 1 including at least one microswitch mounted in each of said first and second variable volume means for sensing operation of the first and second variable volume means.

9. The apparatus according to claim 1 including at least one microswitch mounted in each of said first and second variable volume means for sensing operation of said first and second variable volume means, a monitoring circuit connected to said microswitches and a vacuum pump in fluid communication with said connector and said first and second variable volume means and connected to said monitoring means, said monitoring circuit being responsive to signals generated by said microswitches for controlling said pump.

10. The apparatus according to claim 1 including at least one microswitch mounted in each of said first and second variable volume means for sensing operation of the first and second variable volume means, a monitoring circuit connected to said microswitches and a pressure pump in fluid communication with said connector and said first and second variable volume means and connected to said monitoring means, said monitoring circuit being responsive to signals generated by said microswitches for controlling said pump.

11. An entraining and unlatching apparatus for elevators having a car with a door, the car being movable in a shaft having at least one opening with a shaft door, the car door and the shaft door being latched when the car is spaced from the shaft door and the car door and the shaft door being unlatched and entrained when the car is adjacent the shaft opening, comprising:

an actuator means for mounting on a wall of an elevator car, said actuator means being selectively actuatable for latching and unlatching a door of the elevator car;

a first bellows having one end for mounting on the car wall and an opposite end attached to said actuator means;

an entraining and unlatching cam for mounting on the elevator car door, said cam being movable in a generally horizontal direction for extending toward and retracting from entraining and unlatching rollers mounted on an elevator shaft door when the elevator car is adjacent the shaft door;

a second bellows having one end for mounting on the elevator car door and an opposite end attached to said cam for moving said cam in a generally horizontal direction extending toward and retracting from the rollers; and a flexible connector connected between said first and second bellows, said connector and said first and second bellows being in fluid communication and retaining a predetermined volume of fluid, whereby when said actuator means is actuated to latch the car door, said fluid flows in one direction between said first and second bellows to retract said cam out of contact with the rollers and when said actuator means is not actuated, the car door is unlatched and said fluid flows in an opposite direction between said first and second bellows to extend said cam into contact with the rollers thereby entraining the car door with the shaft door.

12. The apparatus according to claim 11 wherein said connector and said first and second bellows are connected in a closed system and said fluid is at less than atmospheric pressure.

13. The apparatus according to claim 11 wherein said connector and said first and second bellows are connected in a closed system and said fluid is at greater than atmospheric pressure.

14. The apparatus according to claim 11 wherein when said actuator means is not actuated, said connector and said first and second bellows are in fluid communication with atmospheric pressure.

15. The apparatus according to claim 11 wherein said actuator means includes an electromagnet having an armature movable into and out of a latch opening formed in the car door and said opposite end of said first bellows is attached to the armature.

16. The apparatus according to claim 11 wherein said entraining and unlatching cam includes at least one cam entry surface connected to at least one cam surface for engaging the entraining and unlatching rollers and said opposite end of said second bellows is attached to said cam entry surface and said cam surface.

17. The apparatus according to claim 11 including at least one microswitch mounted in each of said first and second bellows for sensing operation of said first and second bellows, a monitoring circuit connected to said microswitches and a pump in fluid communication with said connector and said first and second bellows and connected to said monitoring means, said monitoring circuit being responsive to signals generated by said microswitches for controlling said pump.

18. The apparatus according to claim 11 including an elastic bearing block for mounting on the shaft door, a pair of axles each having one end attached to said block and a pair of said entraining and unlatching rollers, each said roller mounted on a respective one of said axles for engaging said cam, said block permitting said axles to splay apart and fold together.

19. An entraining and unlatching apparatus for elevators having an elevator car with a car door, the car being movable in an elevator shaft having at least one shaft door, comprising:

an electromagnet for mounting on a wall of an elevator car, said electromagnet having a movable armature for latching and unlatching a door of the elevator car;

a first bellows having one end for mounting on the car wall and an opposite end attached to said armature;

an elastic bearing block for mounting on a door of an elevator shaft;

a pair of axles each having one end attached to said block and an opposite end;

a pair of entraining and unlatching rollers, each said roller mounted on said opposite end of a respective one of said axles, said block permitting said axles to splay apart and fold together;

a shaft door latching means coupled to said axles;

an entraining and unlatching cam for contacting and splaying apart said rollers when the elevator car is adjacent the shaft door;

a second bellows having one end for mounting on the elevator car door and an opposite end attached to said cam for moving said cam in a generally horizontal direction extending toward and retracting from said rollers; and a flexible connector connected between said first and second bellows, said connector and said first and second bellows being in fluid communication and retaining a predetermined volume of fluid, whereby when said electromagnet is actuated to move said armature to latch the car door, said fluid flows in one direction between said first and second bellows to retract said cam from contact with said rollers and said shaft door latching means latches the shaft door and when said electromagnet is not actuated, the car door is unlatched and said fluid flows in an opposite direction between said first and second bellows to extend said cam into contact with said rollers to unlatch the shaft door and entrain the shaft door with the car door.

* * * * *